US005586871A

United States Patent [19]

Barnes et al.

[11] Patent Number: 5,586,871

[45] Date of Patent: Dec. 24, 1996

[54] ELECTRIC MOTOR DRIVEN FAN WITH WATER BAFFLE

[75] Inventors: Steven J. Barnes, Kettering; Scott R. Spence, New Carlisle, both of Ohio

[73] Assignee: ITT Automotive Electrical Systems, Inc., Auburn Hills, Mich.

[21] Appl. No.: 479,675

[22] Filed: Jun. 7, 1995

[51] Int. Cl.[6] ..... F04B 35/04

[52] U.S. Cl. ..... 417/423.11; 415/173.7

[58] Field of Search ..... 417/423.11, 423.1; 415/173.7, 174.5, 208.2, 211.2

[56] References Cited

U.S. PATENT DOCUMENTS

| | | | |
|---|---|---|---|
| 3,659,567 | 5/1972 | Murray | 123/41.12 |
| 3,837,421 | 9/1974 | Ron | 180/79.2 |
| 4,005,636 | 2/1977 | Dunn | 91/31 |
| 4,043,419 | 8/1977 | Larson et al. | 180/132 |
| 4,075,840 | 2/1978 | Jesswein | 60/422 |
| 4,130,990 | 12/1978 | Amedei et al. | 60/422 |
| 4,179,888 | 12/1979 | Goscenski Jr. | 60/420 |
| 4,189,919 | 2/1980 | Goscensii, Jr. | 60/420 |
| 4,262,580 | 4/1981 | Goff et al. | 91/532 |
| 4,343,151 | 8/1982 | Lorimor | 60/422 |
| 4,410,058 | 10/1983 | Dymond | 180/143 |
| 4,414,809 | 11/1983 | Burris | 60/424 |
| 4,420,934 | 12/1983 | Udono | 60/422 |
| 4,446,697 | 5/1984 | Goscenski, Jr. | 60/443 |
| 4,463,557 | 8/1984 | Miller et al. | 60/422 |
| 4,559,777 | 12/1985 | Leiber | 60/422 |
| 4,663,936 | 5/1987 | Morgan | 60/422 |
| 4,738,330 | 4/1988 | Suzuki et al. | 180/141 |
| 4,966,066 | 10/1990 | Kauss et al. | 91/516 |

*Primary Examiner*—Charles G. Freay
*Attorney, Agent, or Firm*—Jacox, Meckstroth & Jenkins

[57] ABSTRACT

An electric motor driven fan particularly for use on motor vehicles where water may be splashed into and onto the fan motor, includes a labyrinth-like seal in which a pair of concentric rings are formed on an integral with the fan hub and extend toward the drive motor defining an annular space therebetween, and the motor mounting bracket is provided with a non-rotating ring concentric to the pair of rings on the hub and extending from the bracket into the annular space, thereby preventing direct splash in or straight line intrusion of water into the space between the motor housing and the hub.

5 Claims, 2 Drawing Sheets

ELECTRIC MOTOR DRIVEN FAN WITH WATER BAFFLE

BACKGROUND OF THE INVENTION

Electric motor components which are used in motor vehicle applications, such as under the hood of an automobile or truck, are subject to water spraying, particularly when the vehicle is run through standing water in heavy precipitation. A particularly critical component is the electric motor driven fan assembly which forces cooling air through a radiator or other heat exchange device.

Conditions often require that the fan motor be directly exposed to water splashing into the engine compartment from the wheels, driven through the radiator or pulled through the radiator by the fan blades in heavy precipitation. Since the drive motors commonly have ventilating apertures which provide cooling air flow to the motor. The induction of water, particularly including road salts or other corrosive elements carried by the water, may be highly destructive to the steel cases, armature, laminations, the windings, commutator, brushes, and the motor bearings. The corrosive effects of road salts, for example, are greatly enhanced by the fact that the fan motor is normally operating at an elevated temperature due to the heat losses within the fan motor, engine temperatures, and the heat picked up by the air as it is drawn through the radiator. Such higher temperatures radically accelerate the effects of corrosion.

Fan motors can be totally sealed against intrusion of foreign matter, including water, but this is necessarily at the expense of having to provide much lower wattage rated motors, or much higher temperature rated materials, insulation, windings and the like and, for continuous operation, to provide a suitable means or heat sink for heat to be carried away from the fan motor itself. Therefore, it has become common practice to provide air circulation apertures in the end bell or end wall of the electric drive motor case at a position most closely adjacent the fan blade hub. When water is sprayed up from the wheels or is entrained in the air, it may enter the motor through the ventilating openings.

SUMMARY OF THE INVENTION

The invention is directed to an electric motor and fan combination, particularly adapted for automotive-type use in which a barrier or baffle is formed at the interface between the fan hub and the motor housing or the motor mounting bracket, which operates to prevent a direct intrusion of water between the motor and the fan hub. This is accomplished in this invention by forming at least two, and preferably three, interfitting and spaced rings, each of which have overlying annular portions. These portions define a circuitous or labyrinth-like path which prevents direct or straight line intrusion of water, and causing any water which would otherwise intrude to be deflected from its path at least twice.

The labyrinth-like ring-formed path has the effect of decreasing the velocity of the water spray, by absorbing the kinetic energy of the moving water. At that time, since at least one of the rings is rotating with the hub when the fan is running, this rotating member additionally acts as a slinger to impart a centrifugally directed force to the water, thereby assisting in the exclusion of such water into the space between the fan hub and the air inlets in the fan motor case.

It is therefore an important object of the invention to provide an electric motor driven fan for motor vehicle use in which the cooling inlets of the fan motor positioned between the fan blade hub and the adjacent motor housing are protected from direct entrance of water into that region by splashing or the like employing two or more mutually interfitted non-contacting axially extending rings mounted respectively between the fan hub and the motor housing, or supporting structure for the motor housing, thereby forming a labyrinth-like water barrier.

A further object of the invention is the provision of an electric motor driven fan for motor vehicle use which has improved protection against the intrusion of water and road chemicals into the fan motor.

A more particular object of the invention is the provision of a labyrinth-like barrier between a fan blade hub on the one hand and a motor mounting bracket on the other hand which serves to prevent direct splash-in access to the space between the bracket and the motor and which also serves, when the fan is running, as a slinger which throws out, by centrifugal force, such water or chemicals which come into contact with one or more of the rotating rings.

Other objects and advantages of the invention will be apparent from the following description, the accompanying drawings and the appended claims.

DESCRIPTION OF THE PREFERRED EMBODIMENTS

Figure 1:
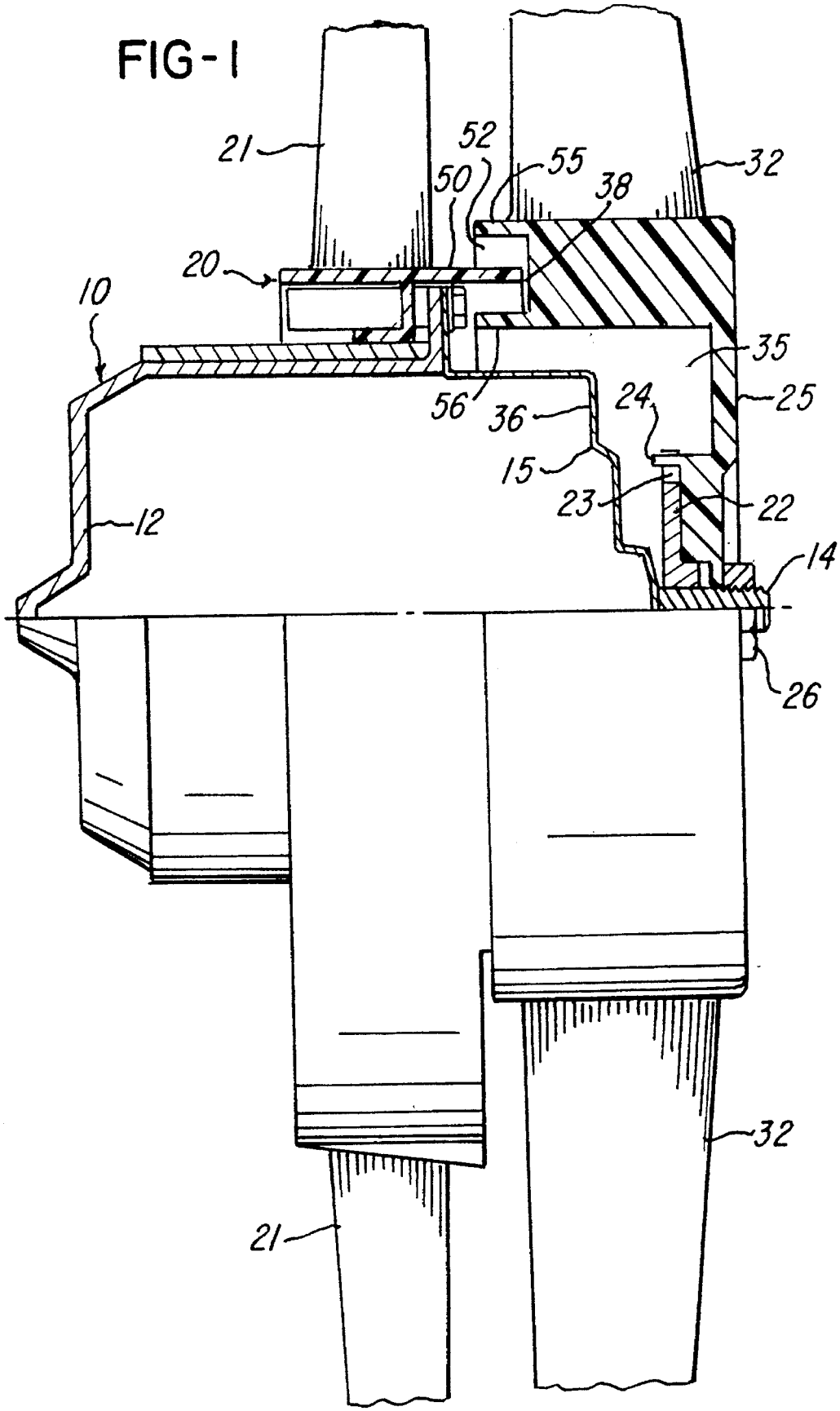
FIG. 1 is a partial section, partial elevational view through a motor case, a motor mounting bracket, and a fan hub constructed according to the teachings of one embodiment of this invention.

Referring to the figures of the drawing which illustrate preferred embodiments of the invention, an electric motor driven fan assembly for motor vehicle use, such as for inducing airflow through a radiator, is illustrated, in partial sectional view in FIG. 1. The electric motor driven fan includes an electric drive motor illustrated generally by the reference numeral 10 and depicted, partially in section, by the motor case 12. It will be understood that this motor may be a conventional brush-type direct current motor or, in appropriate cases, a brushless motor, intended for continuous or relatively continuous operation in driving a primary or auxiliary cooling fan. For this purpose, the motor 10 as shown as being provided with an output or drive shaft 14 extending through a suitable bearing, not shown, in a front case wall 15.

The motor 10 is removably mounted in a motor support bracket 20, which may be formed of high impact resistant molded material, and which is conventionally retained in position, in immediate proximity to the heat exchanger or radiator involved. As illustrated, the bracket 12 may include a plurality of integral support arms also doubling as stator vanes 21 for straightening the airflow through the motor driven fan assembly, as well-known in the art.

Figure 2:
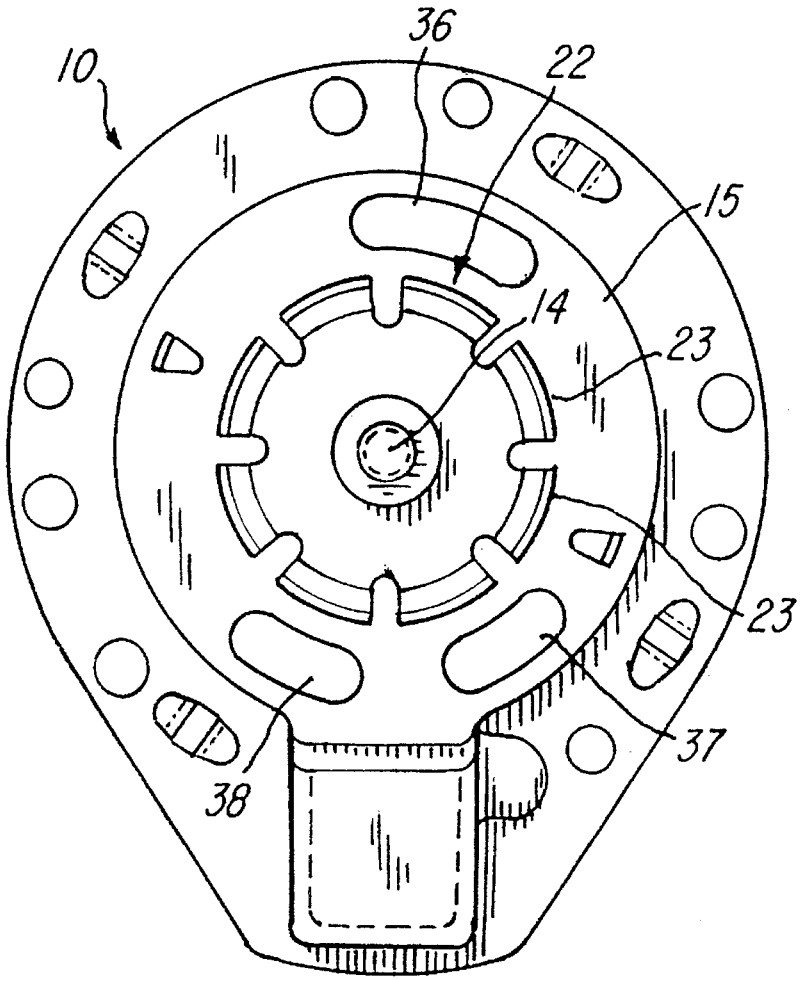
FIG. 2 is a front elevational view of the motor of FIG. 1 showing typical ventilation openings formed in the motor case.

The shaft 14 of the motor 10 is provided with a conventional hub-connecting spindle 22, as shown in elevation in FIG. 2. The spindle is provided with fingers or lugs 23 by means of which a positive torque connection is made to interfitting ledges 24 of a fan hub 25. The assembly of the fan hub 25 on the motor shaft 14 is retained by a conventional left-hand thread or right-hand thread hub nut depending on rotation of the motor 10.

The fan hub 25 is conventionally formed with a closed front wall 30 and a plurality of integral generally radially extending blades 32. The fan hub 25 may also be injection molded of an high impact resistant material, such as a glass-filled nylon.

Viewing FIG. 1, it will be seen that there is an open space 35 defined between the hub 25 and the motor front case wall 15. This open space, besides forming and defining a necessary clearance between the hub 25 and the motor 10, also provides an open space for the admission of ventilating air into one or more motor ventilating openings commonly formed in the motor case front wall 15. These openings are best shown in elevational view in FIG. 2 as including generally arcuately-shaped openings 36,37 and 38. Of course, fewer or greater number of such openings may be pierced or otherwise formed in the motor front wall 15, as necessary, to provide adequate cooling to the motor windings.

It is common practice to provide a radially straight running gap or clearance between the fan hub 25 on the one hand and the motor mounting bracket 20 on the other hand. This running clearance is an invitation for the entrance water, road chemicals and the like which are sprayed upwardly or within the motor compartment, to enter into the space 35 and thus contaminate the motor by entrance through one or more of the ventilating openings, previously described. This invention, the preferred embodiment of which is illustrated in FIG. 1, provides a labyrinth-like barrier which prevents such direct or straight line water intrusion and also which resists all water intrusion.

Thus, for this purpose, the fan assembly of the invention is provided with a plurality of axially extending rings at least some of which are mutually interfitted with others. Thus, the bracket 20 is shown as being provided with a generally axially extending concentric ring 50 which is formed integrally with the bracket 20. The ring 50 extends into an annular cavity 52 defined by a pair of eccentric rings 55 and 56 integrally formed with the fan hub 25 and extending toward and in overlapping but non-contacting relation with the ring 50. Necessarily, a running clearance 58 is formed between ring 50 and the base or bottom of the cavity 52. The extent of ring overlap approximates the space between rings 55 and 56.

The three interfitting rings provide a passage through which air may flow out of or into the space 35, but prevent a straight line or direct intrusion of sprayed, possibly fast moving, water or the like by reason of forming a serpentine-like pathway. Further, since the rings 55 and 56 rotate as part of the hub 25, these act as slinger rings so that water particles impinging upon one or the other of these rotating rings are reaccelerated annularly, by reason of rotation of the hub, and then subjected to centrifugal force which tends to fling the liquid radially outwardly and thereby further protect the space 35 from contamination.

Figure 4:
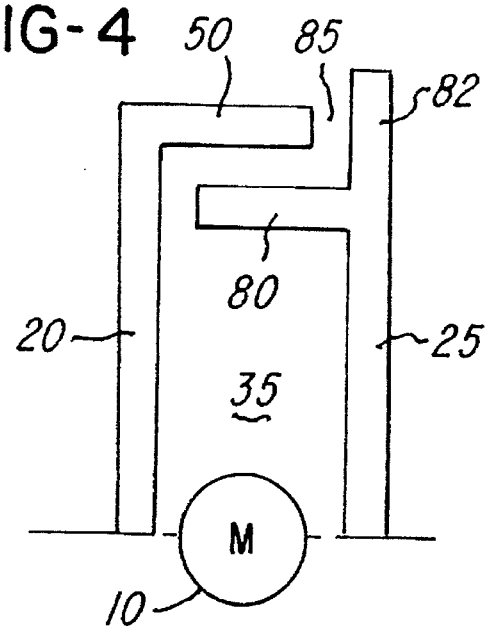
FIG. 4 is a further diagrammatic illustration of a second modification of the invention.
Figure 3:
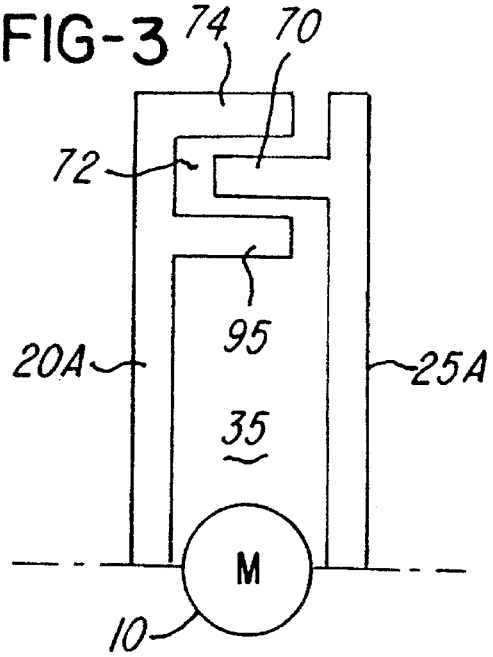
FIG. 3 is a diagrammatic illustration of a first modification of the invention.

FIGS. 3 and 4 diagrammatically illustrate alternative embodiments which in FIG. 3, the relative position of the rings of the embodiment of FIG. 1 are reversed. Thus, the fan hub **25*a* is formed with a single axially extending ring 70 which interfits within an annular cavity 72 defined by rings 74 and 75 forming an integral part of the motor mounting bracket 20*a***.

The embodiment of FIG. 4 represents a modification of the embodiment of FIG. 3 in which the motor bracket 20 is formed with a single axially extending ring 50 as in the embodiment of FIG. 1, and in which the fan hub 25 is also formed with a single axially extending ring 80 directed toward the bracket 20 and within the ring 50, and is further provided with a radially extending arm portion 82 which forms a clearance fit 85 with the adjacent axial ring 50. Both of the embodiments of FIGS. 3 and 4 also define relationships which create a labyrinth-like barrier which prevents straight-line intrusion of water radially into the space 35.

While the forms of apparatus herein described constitutes a preferred embodiment of this invention, it is to be understood that the invention is not limited to these precise forms of apparatus, and that changes may be made therein without departing from the scope of the invention which is defined in the appended claims.

What is claimed is:

1. In an electric motor driven fan for motor vehicle use including an electric fan motor having a motor shaft and a motor housing, a fan hub on said motor shaft spaced from said motor housing and supporting a plurality of fan blades, a motor support bracket by which the fan motor is supported, at least one ventilating aperture formed in said motor housing and opening into the space between the motor housing and said fan hub, the improvement for preventing direct entrance of water into the motor ventilation opening and into the space between said motor housing and said fan hub, comprising:

a plurality of axially extending rings including at least one ring mounted concentrically to said motor shaft on said fan hub and extending axially toward said motor housing, and at least one ring mounted on said motor mounting bracket and extending axially toward the other said ring and in overlapping relation thereto and defining between said rings a passage through which air may flow, said annular rings forming a labyrinth-like barrier preventing straight line intrusion of water radially inwardly into said space and ventilating aperture.

2. In an electric motor driven fan for motor vehicle use, including an electric fan motor having a motor shaft and a motor housing, a fan hub on said motor shaft spaced from said motor housing and supporting a plurality of fan blades, a motor support bracket by which the fan motor is supported, at least one ventilating aperture formed in said motor and opening into the space between the motor housing and said fan hub, the improvement for preventing direct entrance of water into the motor ventilation opening and into the space between said motor housing and said hub, comprising:

at least three annular axially extending rings including a pair of said rings mounted concentrically on one of said hub and bracket and extending axially toward the other of said hub or bracket and defining therebetween an annular space, and a third said ring mounted on the other of said hub or bracket and extending into said annular space in non-contacting relation with said ring pair and defining with said ring pair a passage through which air may flow, said annular axially extending rings forming a labyrinth-like barrier preventing straight-line intrusion of water radially inwardly into said space.

3. An electric motor driven fan particularly adapted for motor vehicle use having improved protection against direct splash-in of water, comprising:

a motor having an outer housing and having a shaft extending therefrom, a non-rotating support bracket surrounding said motor housing for supporting said motor, a bladed fan mounted on said motor shaft, said bladed fan having a circular hub spaced from said housing and a plurality of blades extending generally radially from said hub, said motor housing having at least one ventilation aperture therein opening into said space between said motor housing and said hub, a first annular ring integrally formed on said motor bracket and extending axially toward said hub in concentric relation to said shaft, a second annular ring integrally formed with said hub in concentric relation to said shaft and extending axially in overlapping and non-contacting relation with said first ring and defining between said rings a passage through which air may flow, said rings defining a labyrinth-like barrier preventing straight-line intrusion of water into said space between said motor housing and said fan hub.

4. The motor-driven fan of claim 3, further comprising a third annular ring integrally formed with said hub in concentric relation to said second ring and extending axially of said hub and defining with said second ring an annular open space, and in which the said first ring extends between said second and third rings into said annular open space, and in which the axial extent of overlap between said first ring and one or the other of said second and third rings is greater than the radial spacing between said first ring and one or the other of said second and third rings.

5. The electric fan motor of claim 4, in which the radial depth of said annular space defined between said second and third rings is approximately equal to the length of said axial overlap.

* * * * *